United States Patent [19]

Offutt et al.

[11] Patent Number: 4,912,359

[45] Date of Patent: Mar. 27, 1990

[54] STOPPERING TRAY VACUUM FREEZE DRYER

[75] Inventors: Bradley E. Offutt, Independence; Larry W. Nelson, Kingsville, all of Mo.

[73] Assignee: Labconco Corporation, Kansas City, Mo.

[21] Appl. No.: 299,128

[22] Filed: Jan. 23, 1989

[51] Int. Cl.[4] ..... A47B 57/00

[52] U.S. Cl. ..... 312/306; 108/147

[58] Field of Search ..... 312/306, 312; 108/144, 108/147; 211/187

[56] References Cited

U.S. PATENT DOCUMENTS

| | | | |
|---|---|---|---|
| 2,429,523 | 10/1947 | Murphy | 312/312 X |
| 2,713,520 | 7/1955 | Greene | 108/147 X |
| 3,300,262 | 1/1967 | Stephenson | 312/272 X |
| 3,316,044 | 4/1967 | Carbary | 312/272 X |
| 3,339,795 | 9/1967 | Cappel | 312/306 X |
| 3,415,586 | 12/1968 | Hammond | 312/306 X |
| 4,161,234 | 7/1979 | Munn | 312/306 |
| 4,619,208 | 10/1986 | Kurrasch | 108/149 X |
| 4,651,652 | 3/1987 | Wyckoff | 108/144 |
| 4,751,884 | 6/1988 | Ball | 108/144 |

*Primary Examiner*—Joseph Falk

*Attorney, Agent, or Firm*—Kokjer, Kircher, Bradley, Wharton, Bowman & Johnson

[57] ABSTRACT

A freeze dry unit having several novel features is the subject of this invention. A plurality of shelves are placed in the drying unit and are coupled with cables which serve to interconnect three points on each shelf. This assures that an upward force applied at any point on the shelf will be distributed over the entire shelf and the shelf will rise in a true horizontal plane. An improved refrigeration system is also provided which incorporates an auxiliary capillary tube that can be bypassed by a solenoid valve or used to reduce the volume of refrigerant flowing through the system thereby decreasing the load on the compressor. The invention also encompasses a closure door that incorporates a novel hinge and mounting assembly which assures that opening and closing of the door will not pinch the door seal thus deteriorating it. The door assembly also provides for the application of closing forces to be distributed relatively equally over all four sides of the door panel thus facilitating formation of an airtight seal.

5 Claims, 3 Drawing Sheets

STOPPERING TRAY VACUUM FREEZE DRYER

This invention relates generally to freeze drying equipment and, more particularly, to a freeze dryer which is provided with a mechanism for placing stoppers in vials subsequent to the drying step and before the vacuum conditions have been terminated Freeze drying is a technique well known to those skilled in the art for preserving both plant and animal biological materials. For relatively small production or laboratory requirements, so-called "stoppering tray dryers" have long been in use. These units are normally relatively small and are designed to freeze dry and stopper a large number of small vials or other "laboratory size" vessels. It is known in the art to utilize movable shelves inside of a stoppering tray dryer along with an inflatable bladder which raises one or more shelves until the stoppers on the vials of the shelf being raised contact the horizontal shelf or frame section immediately above it thus forcing the stoppers into sealing relationship with the vial.

Stoppering tray dryers have heretofore encountered the problem that, when the shelves are raised, it is not always possible to keep the shelf in a horizontal plane. This may cause one or more vials to tip over or, if a vial is already tipped over, damage to the shelf or other vials may occur because of the unequal forces applied to the shelf when the inflatable bladder is actuated.

Another difficulty with stoppering tray dryers of the type that have heretofore been commercialized is the need to size the refrigeration compressor to handle maximum cooling requirements, namely those required to effect the initial freezing of the sample. This means that once the sample is frozen and a vacuum is applied, there is excess refrigeration capacity because of the lowered pressure inside of the dryer. The excess refrigeration capacity means that the compressor life will be unnecessarily shortened, energy requirements will be increased and more energy will need to be expended to heat the sample sufficiently to vaporize the frozen water molecules.

Another deficiency of previous stoppering tray dryers has been the access door. Such a door must seal properly to assure that a vacuum can be created and held within the chamber during the drying process. Oftentimes, the seal surrounding the door becomes deformed by repeated openings and closings. Even under the best of circumstances, doors for freeze drying units have typically been somewhat difficult to seal air tight and may require more than one attempt or the application of external forces before sealing is achieved.

The foregoing shortcomings of the prior art stoppering tray dryers are addressed by the present invention. This invention provides for an improved means for sealing the door of a freeze dry unit and an improved mechanism for raising the shelves of a freezer dryer during the stoppering procedure. Additionally, the invention provides for an improved refrigeration unit which allows for two stage cooling thus reducing the load on the refrigeration compressor as well as saving energy.

It is, therefore, a primary object of the present invention to provide a refrigeration unit which is particularly applicable, though not limited, to freeze dryers wherein the volume of refrigerant passing through the evaporator may be reduced when cooling requirements are less thereby reducing the load on the compressor so as to lengthen the life of the compressor and reduce energy requirements.

As a corollary to the foregoing object, an objective of the invention is to provide a refrigeration unit having two stage cooling which uses a standard 15 amp 125 volt circuit for power.

Another one of the objectives of our invention is to provide a stoppering tray dryer having movable shelves wherein means is provided to assure that the shelves will move in a horizontal plane regardless of whether or not the moving force is applied uniformly.

As a corollary to the objective last stated above, an important aim of the invention is to provide means for moving the movable shelves of a stoppering tray dryer wherein the shelves are assured of remaining in a horizontal plane at all times thus reducing the possibility of the shelves causing a container to spill or break because of a shelf being out of plane.

Another object of this invention is to provide a stoppering tray dryer wherein the movable shelves are provided with means for maintaining the shelves in a horizontal position during their movement so as to reduce the chances for the shelves becoming jammed.

It is also one of the objects of the invention to provide an improved locking mechanism for the door of a stoppering tray dryer which provides a more reliable seal than previous locking mechanisms as a result of applying the locking force at the center of the door.

A further aim of the invention is to provide an improved door construction for a stoppering tray dryer wherein the door moves away from the adjacent sealing strip during opening so as to preclude damage to the seal by repeated opening and closing of the door.

Other objects of the invention will be made clear or become apparent from the following description and claims when read in light of the accompanying drawing wherein:

Figure 3:
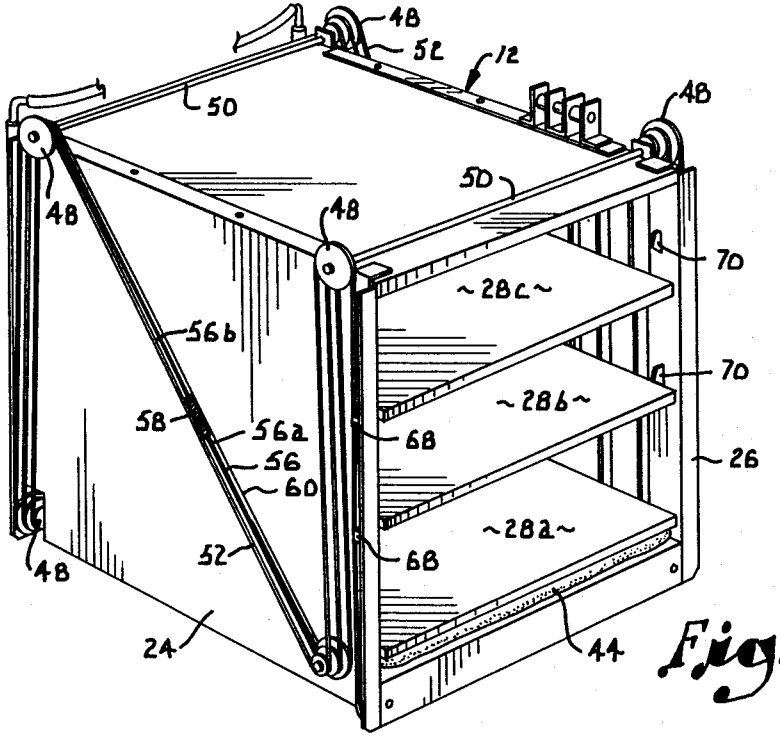
Figure 2:
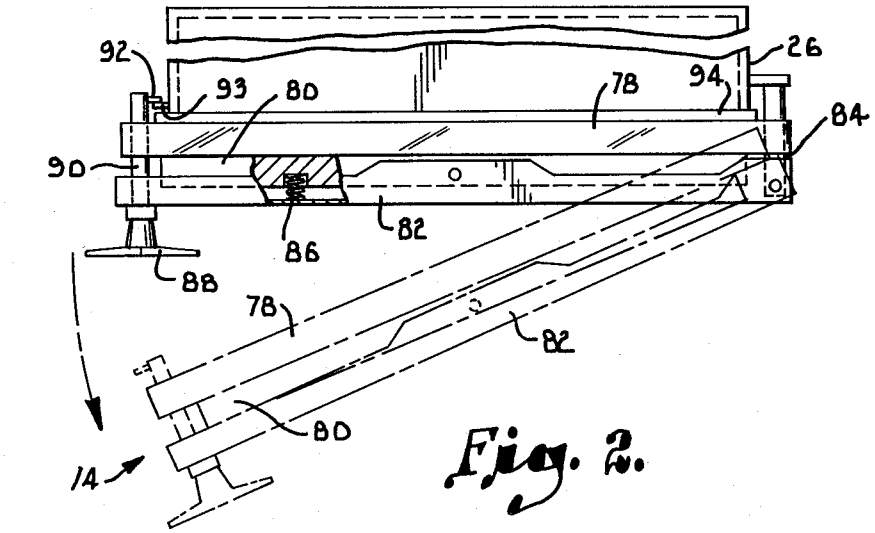
FIG. 2 is an enlarged fragmentary top plan view looking in the direction of arrows 2—2 of FIG. 1 and illustrating the door closure mechanism.
Figure 2A:
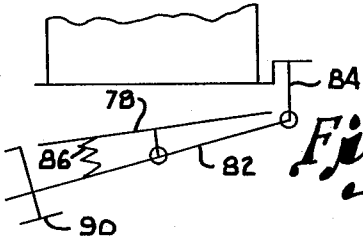
Figure 2B:
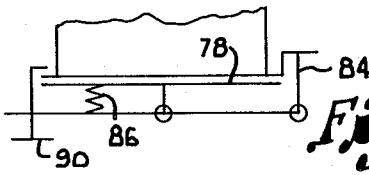
Figure 12:
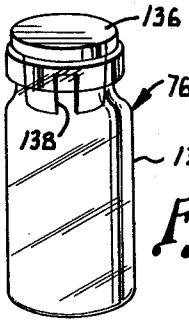
Figure 4:
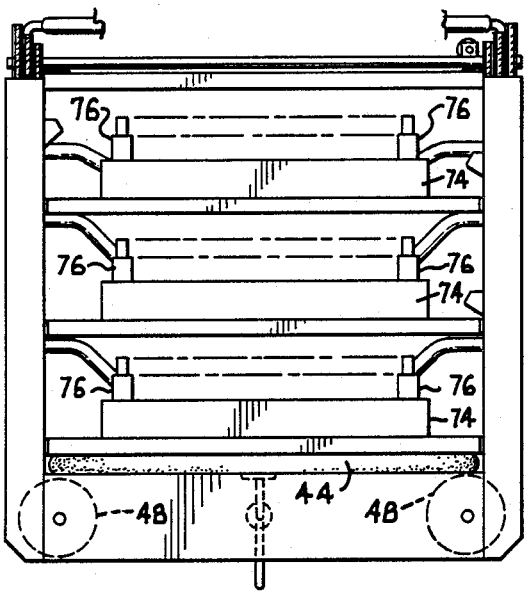
Figure 5:
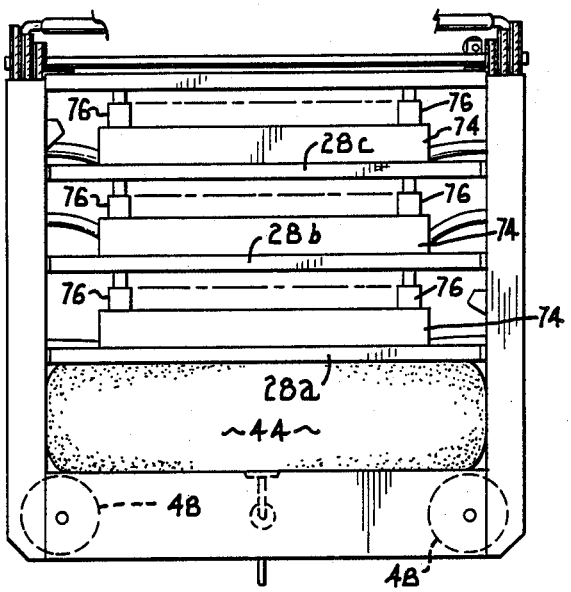
Figure 6:
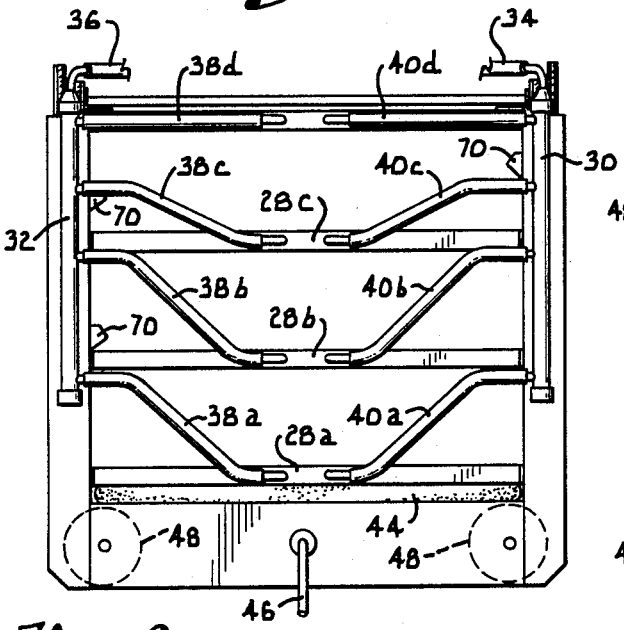
Figure 7:
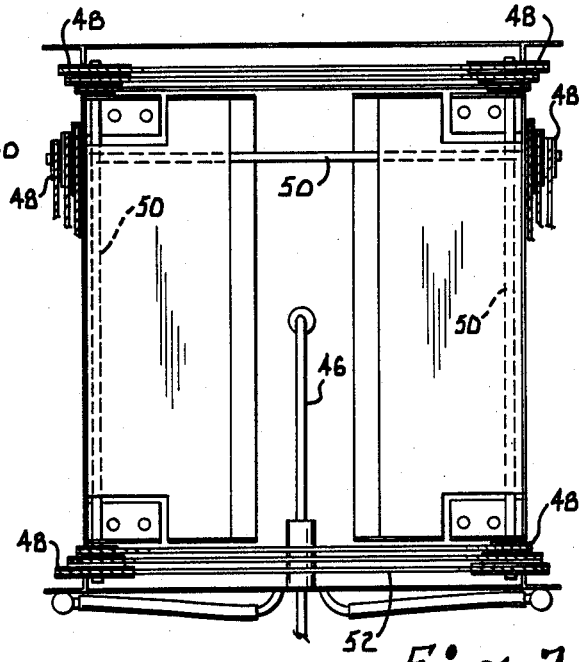
Figure 9:
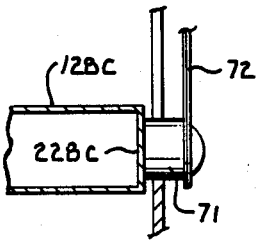
Figure 10:
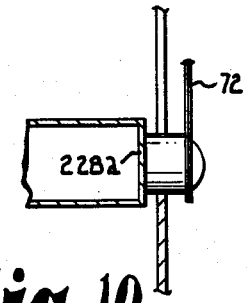
Figure 11:
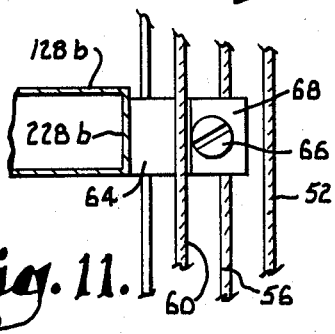
Figure 8:
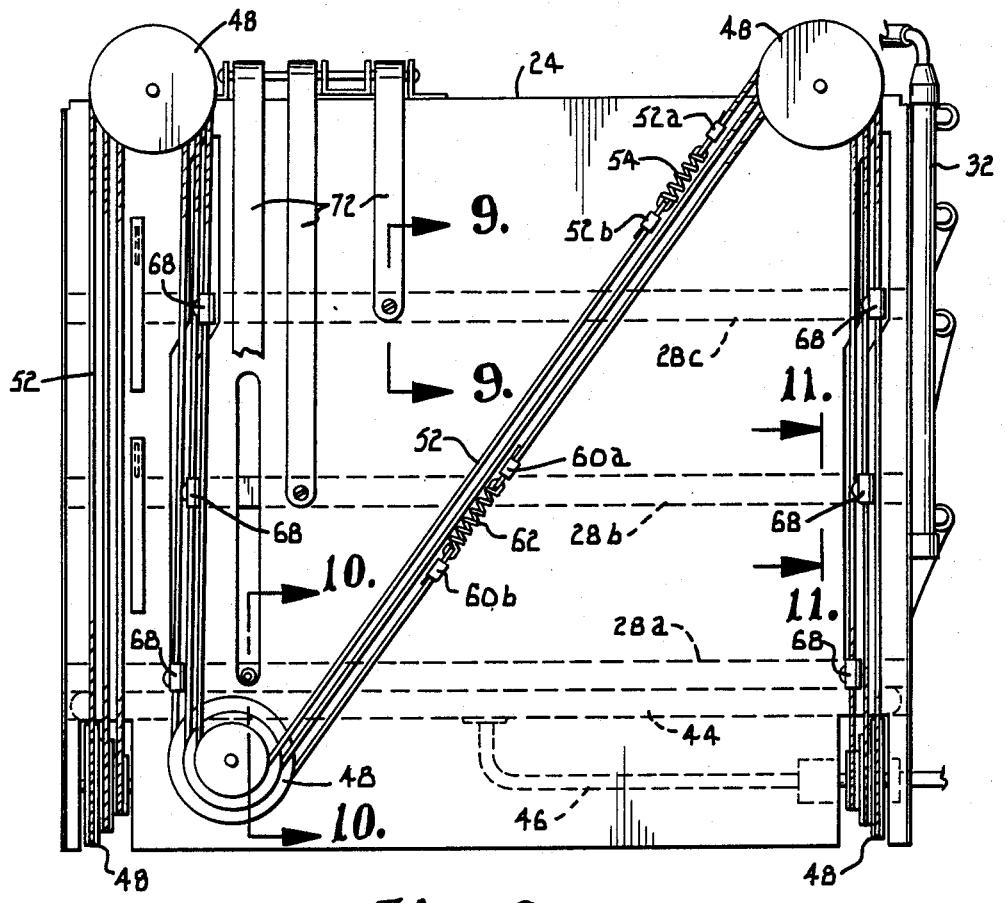
Figure 13:
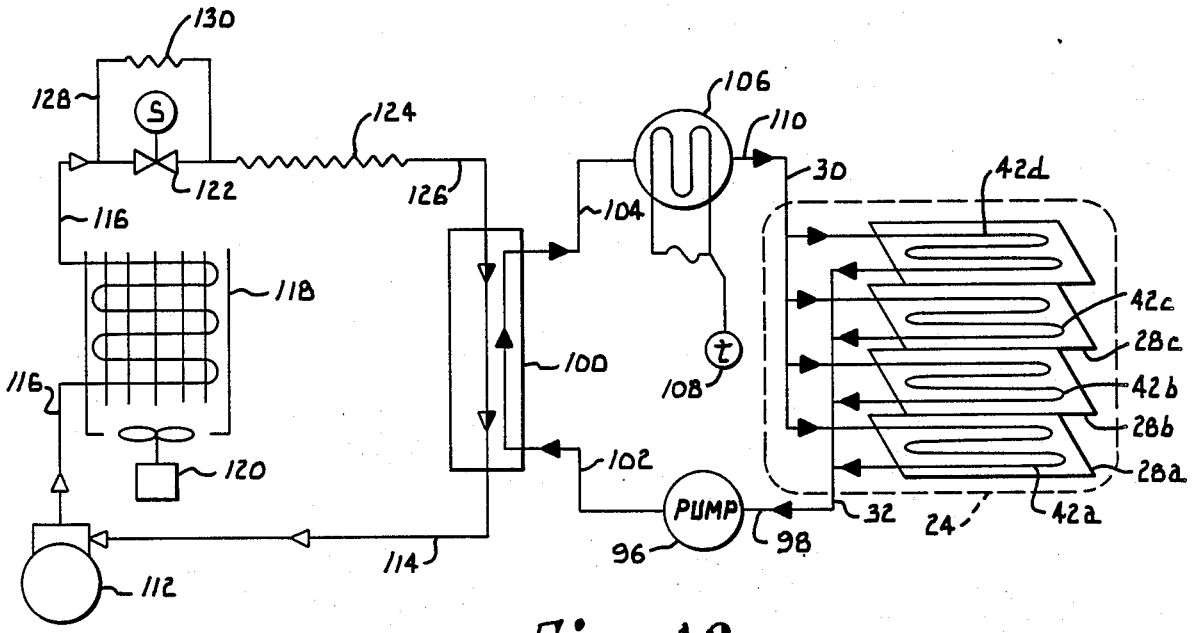

FIGS. 2*a* and 2*b* are schematic illustrations of the door closure mechanism in both open and closed positions;

FIG. 3 is an enlarged perspective view of the freezing and drying chamber showing the movable shelves and the associated structure which assures the shelves will remain level during movement;

FIG. 4 is a front elevational view of the drying and freezing chamber with the shelves in their lowered positions as would be the case during the freezing and drying mode of operation;

FIG. 5 is another front elevational view, similar to FIG. 4, after the shelves have been moved to their raised positions to effect stoppering after the freezing and drying has been completed;

FIG. 6 is a rear elevational view of the freezing and drying chamber with the shelves in the same position as shown in FIG. 4;

FIG. 7 is a bottom plan view of the freezing and drying chamber;

FIG. 8 is an enlarged elevational view of one side of the freezing and drying chamber;

FIG. 9 is a vertical cross-sectional view taken along line 9—9 of FIG. 8;

FIG. 10 is a vertical cross-sectional view taken along line 10—10 of FIG. 8;

FIG. 11 is a vertical cross-sectional view taken along line 11—11 of FIG. 7;

FIG. 12 is an elevational view of a stoppered vial of the type that would be used with the tray dryer of the present invention; and FIG. 13 is a schematic illustration of the freezing and drying systems according to the present invention.

Figure 1:
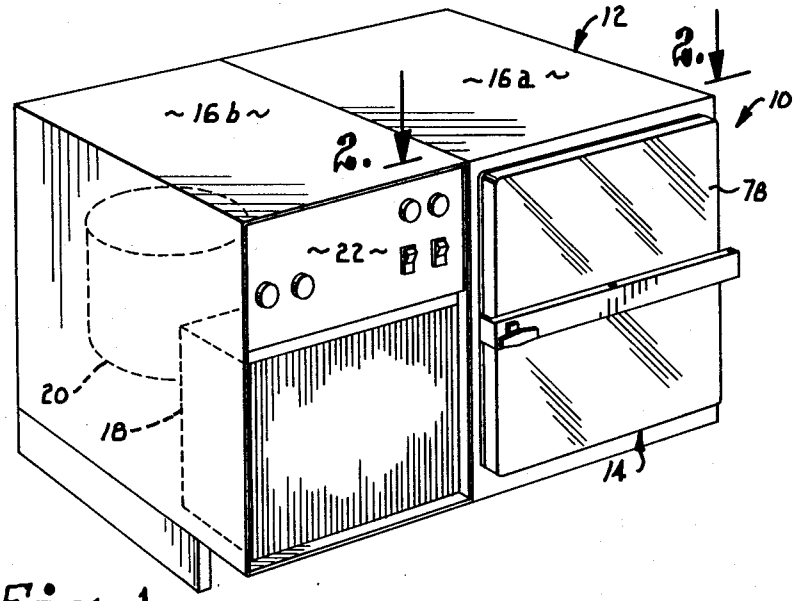
FIG. 1 is a perspective view of a stoppering tray freeze dry unit according to the present invention.

Referring initially to FIGS. 1–3, a stoppering tray freeze dry unit according to the present invention is designated generally by the numeral 10 and includes a freeze drying compartment 12 which is closed by a door 14. A housing 16 has two section sections, 16*a* which encloses compartment 12 and section 16*b* which encloses a condenser 18 (shown schematically in FIG. 1) and a compressor 20. A control panel 22 contains various controls for operating the unit.

Details of the freeze drying compartment 12 will now be described. Compartment 12 includes a structurally rigid enclosure 24 having a top, bottom, back (not shown) and two sidewalls. It is to be understood that enclosure 24 fits inside of the right-hand housing section 16*a*. The top, bottom and sides of the compartment 12 present a flat sealing surface 26 surrounding the open front of compartment 12. Disposed within enclosure 24 are three movable shelves designated by the numerals 28*a*, 28*b* and 28*c*. Each of the shelves is identical in construction and, accordingly, only one will be described in detail.

Referring to FIG. 6 which is a rear view of enclosure 24 with the back removed, fluid supply manifold 30 and fluid return manifold 32 are mounted on the sides of the enclosure and are connected with supply ad return lines 34 and 36, respectfully. Shelf 28*a* is coupled with manifolds 30 and 32 by a shelf supply line 38*a* and a shelf return line 40*a*. The shelf supply and return lines are flexible so as to accommodate vertical movement of the shelves. As illustrated in FIG. 10, shelf 28*a* is constructed with spaced-apart sidewalls 128*a* and 228*a* so as to present a hollow interior. Although not shown in any of the figures heretofore described, shelf 28*a* is provided with a conduit 42*a* (FIG. 13) which is coupled with the supply and return lines 38*a* and 40*a*. The top of enclosure 24 is also of a hollow construction similar to that of shelf 28*a*. The top has a conduit 42*d* enclosed therein and coupled with a supply line 38*d* and a return line 40*d* which are also coupled with manifolds 30 and 32 in the same manner as previously described for the shelves.

With particular reference to FIGS. 6 and 7, an inflatable bladder 44 is disposed between the bottom of enclosure 24 and the lowermost shelf 28*a*. Bladder 44 is coupled with an air supply line 46 which extends from the rear of housing section 16*a*.

Shelves 28*a*, *b* and *c* are movable vertically by virtue of a pulley and cable system which will now be described. With reference to FIG. 3, it can be seen that two triple sheave pulleys 48 are rotatably mounted on a rod 50 which is supported by the top wall of enclosure 24. A second rod 50 is mounted at the top rear of the enclosure and in turn mounts two more triple sheave pulleys 48. With reference to the bottom plan view of FIG. 7, it is seen that a third rod 50 extending along the bottom of the enclosure mounts another set of triple sheave pulleys 48. Finally, fourth and fifth rods 50 disposed in perpendicular relationship to the third rod aforementioned but also located near the bottom of the enclosure mount fourth and fifth sets of triple sheave pulleys 48. It is to be noted that the fourth and fifth rods 50 extend front to back of the enclosure at a 90° angle relative to the third mentioned rod 50 at the bottom of the enclosure. Thus, a total of five rods with ten triple sheave pulleys are mounted on enclosure 24. Four of the pulleys are disposed at the top of the enclosure and six are disposed at the bottom. Half of the ten pulleys are disposed on the right-hand side of the enclosure (although not all in the same plane) and the other half are disposed on the left-hand side of the enclosure (again, not all in the same plane).

With reference to FIG. 3, it will be seen that a first cable 52 is trained over the smallest sheave of the lowermost forward pulley that is completely visible in this FIG. From there, the cable extends to and is trained over the largest sheave of pulley 48 at the top left rear o the enclosure when viewing FIG. 3. Cable 52 then extends downwardly to tee next pulley 48 where it is again trained over the outermost sheave which is also the largest sheave of the pulley 48*a* at the lower left-hand corner of enclosure 24 when viewing FIG. 3. Turning now to FIG. 7, cable 52 extends across the bottom of the enclosure to the next pulley 48 which is the one visible in the lower left-hand corner of FIG. 7. Cable 52 is trained around the largest sheave of this pulley and from there extends upwardly to pulley 48 which is located at the rear right-hand corner of the enclosure when viewing FIG. 3. From this pulley, cable 52 extends downwardly with one end 52*a* being coupled with a coil spring 54 (see FIG. 8). The other end 52*b* of cable 52 is also coupled with spring 54 with the remaining length of cable 52 extending downwardly to the next triple sheave pulley 48 where the cable is trained around the outermost and smallest sheave before extending back upwardly to the next pulley 48, this being the pulley which is shown at the upper left-hand side of the enclosure in FIG. 8. Cable 52 is trained around the largest and outermost sheave of this pulley before extending downwardly to the net pulley 48 shown at the lower left-hand corner of FIG. 8. Cable 52 is trained around the largest and outermost sheave of this pulley and then extends generally horizontally to pulley 48 which is at the upper right-hand corner of FIG. 7 where, again, it is trained over the largest and outermost sheave of the pulley. Next, cable 52 extends upwardly to the last pulley 48, this being the one visible at the upper front left-hand corner of the enclosure when viewing FIG. 3. Again, the cable 52 is trained around the largest and outermost sheave of this pulley after which it extends downwardly to the next pulley 48 as previously described.

A second cable 56 having ends 56*a* and 56*b* which are coupled with a coil spring 58 (left-hand side of enclosure when viewing FIG. 3) is trained around the intermediate sheave of each of the pulleys 48 in the same sequence as previously described for cable 52. It is noted that all of the intermediate or middle sheaves of the pulleys 48 are of the same diameter. A third cable 60 having ends 60*a* and 60*b* coupled with a coil spring 62 is trained around the innermost sheave of each of pulleys 48 in the same sequence as described for the first cable 52. It is, of course, to be understood that in each case where the cable 52 is trained around the outermost sheave of the pulley, the cable 60 will be trained around the innermost sheave. Similarly, in each case where cable 52 is described as being trained around the smallest diameter sheave, the cable 60 will be trained around the largest diameter sheave.

Referring to FIGS. 3, 8 and 11, each of shelves 28*a*, 28*b* and 28*c* is rigidly coupled with one of the cables 52, 56 or 60 at three spaced apart locations. In this regard, three tabs 64 (FIG. 11) are rigid with each shelf and project through open longitudinal slots in the sidewalls of enclosure 24. Each tab threadably receives a screw 66 which in turn forces a crimp clamp 68 (FIG. 11) into gripping engagement with one of cables 52, 56 or 60. In FIG. 8, two of the clamps 68 for each shelf are visible at the right and left-hand sides of enclosure 24. The third clamp 68 for each of the shelves projects through a vertically extending slot in the left sidewall of the enclosure and these are visible in FIG. 3.

With reference to FIGS. 3 and 6, vertically spaced spring biased latches 70 are positioned along the inside walls of the enclosure 24 so as to support the two uppermost shelves 28*b* and 28*c* at different heights. With reference to FIGS. 8 and 9, the upper two shelves 28*b* and 28*c* are provided with rod-like protrusions 71 which extend through additional vertical slots (not visible) in the sidewall of enclosure 24 and which rod protrusions are coupled with the ends of negator springs 72 mounted atop enclosure 24.

Shelves 28*a, b* and *c* may be used to hold trays 74 (FIG. 4) containing a number of stoppering vials designated generally by the numeral 76 (FIG. 12).

Details of construction of door 14 which closes the front opening of enclosure 24 and provides operator access will now be described. A relatively thick transparent material of a size large enough to cover the front opening presents the closure panel 78. This panel is rigidly coupled with at transversely extending support member 80 which in turn is pivotally coupled with an elongated transversely extending bar 82 at a point midway between the right and left-hand sides of panel 78. Bar 82 is mounted on the sealing surface 26 of enclosure 24 by hinge 84. It is to be understood that the hinge projects through a cutaway portion (no shown) of door panel 78. Yieldable biasing means in the form of a coil spring 86 is disposed between support member 80 and bar 82 between the point of pivotal connection of the support member with the bar and the unhinged side of door panel 78 (see FIG. 2). A handle 88 is coupled with a latching rod 90 which extends through bar 82 and panel 78. A latching pin 92 connected with rod 90 is engageable with a camming surface 93 which projects from enclosure 24 on turning of the handle to securely latch the door against the sealing surface 26. A yieldable sealing strip 94 between door panel 78 and sealing surface 26 assures an airtight seal.

Referring now to the schematic drawing of FIG. 13, the temperature control system which forms a part of freeze dry unit 10 will now be described. Enclosure 24, as has previously been mentioned, is illustrated schematically at the right-hand side of FIG. 13 as are shelves 28*a, b,* and *c* which contain conduits 42*a, b,* and *c* previously described. The top of enclosure 24 contains conduit 42*d*, also as previously described. The conduits are all in fluid communication with supply manifold 30 and return manifold 32, also as described previously. A pump 96 coupled with manifold 32 by a conduit 98 delivers fluid from the manifold to a heat exchanger 100 by way of a conduit 102. Fluid leaves heat exchanger 102 by means of a conduit 104 which is coupled with a heater 106. Heater 106 is controlled by a thermostat 108 set at a preselected temperature. Fluid passes out of heater 106 via a conduit 110 which is in fluid communication with supply manifold 30.

The refrigeration system of the temperature control system is shown at the left-hand side of FIG. 13 and includes a compressor 112 which receives refrigerant from heat exchanger 100 via conduit 114. Refrigerant leaves compressor 112 by means of conduit 116 which follows a serpentine path through a condenser 118 which includes a fan 120. The liquified refrigerant leaves condenser 118 via an extension of conduit 116 where it can follow one of two paths. The first path is through a solenoid valve 122 followed by a relatively long capillary tue 124 which is coupled with heat exchanger/evaporator 100 via a conduit 126. Capillary tube 124 serves to restrict the flow of refrigerant into evaporator 100 thus creating a pressure differential between the condenser and evaporator. An alternative path around solenoid valve 122 is provided by a conduit 128 which includes an additional capillary tube 130 of significantly shorter length than tube 124 which is in fluid communication with the conduit 116 on both sides of valve 122.

Many different types of containers may be employed in the freeze dry unit 10 of the present invention but a type typically used will be the stoppering vial 76 as shown in FIG. 12. Vial 76 includes an open top cylindrical container 134 which is closed by a stopper 136 that is characterized by a channel 138 extending parallel to the vertical axis of the container over a distance equal to approximately one-fourth of the stopper length and terminating at the end of the stopper which is inside of container 134.

In use, the sample to be freeze dried is placed in vial 76 or other suitable container and stopper 136 is placed in the container opening and left in a raised position whereby channel 138 communicates with both the inside and outside of container 134. This allows vaporized ice crystals to escape from the container. As previously mentioned, in most applications a plurality of vials 76 will be placed in a tray 74 and multiple trays will be stacked onto the respective shelves 28*a, b* and *c*, as illustrated in FIG. 4. Door 14 is closed and handle 88 is turned to bring latching pin 92 into engagement with its associated camming surface so as to tightly hold the door against sealing strip 94. The refrigeration system is then activated and heat exchange fluid is circulated through conduits 42*a* through 42*d* by pump 96 so as to lower the temperature in the enclosure 24. While the temperature achieved will vary considerably depending upon the particular sample being frozen, temperatures of −10° F. to −40° F. are typical. During the freezing step, the refrigeration system is working at maximum capacity so as to freeze the sample in the shortest possible time. Following the freezing step, a partial vacuum is created within enclosure 24 utilizing conventional equipment well known to those skilled in the art. Once the desired vacuum conditions have been achieved, the temperature of the samples will be raised sufficiently so as to vaporize the ice crystals which have been formed during the freezing step. To this end, heater 106 is employed to heat the fluid circulating through the supply and return manifolds 30 and 32 and the associated conduits. A predetermined temperature set by thermostat 108 is maintained to within less than 1° F. In order to maintain the temperature at the precise level desired, it will be necessary to utilize a combination of heater 106 and the associated refrigeration system. To this end, the heat exchange fluid circulating through heater 106 and the associated conduits continue to pass in heat exchange relationship with the refrigerant by virtue of the fact that both pass through heat exchanger 100. Once the desired temperature has been achieved, the requirements for refrigeration will be significantly reduced thus allowing a switch to be thrown to close solenoid valve 122 thereby diverting refrigerant passing through conduit 116 to conduit 128 and the associated capillary tube 130. By virtue of the fact that the refrigerant is now having to pass through an additional length of capillary tube, the volume of refrigerant circulating through the system is reduced and the load on compressor 112 similarly lightened. This reduces the energy requirements for the refrigeration system and should result in a longer life for compressor 122. It also allows the compressor to be sized smaller and operate off of a 15 amp 120 volt service. It should be noted that the enclosure 24 will normally be coupled with an ice collecting system of the type well known to those skilled in the art and not shown in the drawings in the interest of brevity.

When the samples have been adequately dried to remove the crystallized water, the vials 76 are sealed shut in the following manner. Air is supplied via line 46 to inflatable bladder 44 which, as it inflates, will raise shelf 28*a*. As illustrated in FIG. 5, when the vials 76 on the first shelf 28*a* reach the second shelf 28*b*, they will cause this shelf to rise until the vials 76 seated thereon contact third shelf 28*c* causing it to rise and contact the top wall of the enclosure. Further pressure from bladder 44 will force the stoppers 136 in each of the vials down into the vial container 134 a sufficient distance so as to close off the air path of channel 138 which terminates at a point below the upper rim of container 134.

By virtue of the fact that each of shelves 28*a* through 28*c* is secured to its associated cable at three spaced apart points, each shelf will rise in a true horizontal plane. This greatly reduces the possibility of a tilted vial or stopper causing a shelf to move in an uneven manner which heretofore has been the cause of vials tipping over and numerous samples being ruined. Similarly, since each shelf is assured of rising in a horizontal plane, the shelf will not bind or otherwise tilt as a result of the forces acting to raise the shelves which in turn could cause vials to tip over and samples to be lost. Negator springs 72 facilitate upward movement of the shelves.

When containers larger than vial 76 are to be utilized in the unit 10, it may be necessary to raise one or both of shelves 28*b* and 28*c* so as to accommodate a taller container on bottom shelf 28*a*. Shelf 28*b* can be raised by lifting it upwardly past the lower spring biased latch 70 and allowing the shelf to rest on the upper horizontal surface of the latch. Similarly, upper shelf 28*c* may be moved past the latch 70 which is above it and allowed to rest on the upper horizontal surface of this latch. This will create additional clearance between the second and third shelves. Finally, both of shelves 28*b* and 28*c* may be moved upwardly past the upper latch 70 until the bottom surface of 28*b* rests on the upper horizontal surface of this latch so as to store both of the upper shelves at the top of the enclosure and allow maximum clearance for one or more containers on the lower shelf 28*a*.

After vials 76 have been sealed, bladder 44 is deflated and shelves 28*a* through 28*c* are returned to their spaced apart relationship illustrated in FIG. 4.

Door 14 is unlocked by rotating handle 88 180° allowing the door to be opened. With reference to FIGS. 2, 2*a* and 2*b*, it is to be noted that, as door 14 opens, spring 86 forces door panel 78 away from elongated bar 82 at the left-hand side of the door while the right-hand side of the door panel moves toward bar 82. This allows the door panel to quickly clear seal 94 as the door is opened. The same is true when the door is moved from an open to a closed position. That is, the right-hand side of the door will be pushed toward bar 82 and away from seal 94 thereby maximizing the clearance for the door panel relative to the seal, thus precluding "pinching" of the seal, while still allowing the door to form n airtight seal once it assumes its closed position (FIG. 2*b*). By virtue of the fact that the door panel 78 is coupled with the support bar 82 at a point approximately at the center of the door, the force applied through the bar to close and lock the door when latching pin 92 engages its associated camming surface will also be applied at the center thereby tending to equalize the forces on all four sides of panel 78. This is to be contrasted with prior art door constructions were one or more latches at one side of the door applied their closing forces primarily against the side where they were located with the forces at the opposite side being considerably less. The application of unequal fores to a door panel is much more likely to result in difficulty in sealing the door along the side which has the least amount of closing force applied to it.

We claim:

1. In an enclosure having a vertically movable shelf, an assembly for facilitating movement of the shelf in a horizontal plane, said assembly comprising:

cable means coupled with said shelf at at least three spaced apart locations;

four upper pulley means mounted on said enclosure at spaced apart locations in a plane above the highest plane to which said shelf is to be raised, two of said upper pulley means being disposed on one side of said enclosure and two on the other side;

six lower pulley means mounted on said enclosure at spaced apart locations in a plane no higher than the lowest plane in which said shelf is to be positioned, three of said lower pulley means being disposed on one side of said enclosure and three on the other side;

said cable means trained over one of said upper pulley means, then over a lower pulley means, then over another upper pulley means, then over another lower pulley means, all of the foregoing pulley means being disposed on one side of said enclosure, thence to another lower pulley means on the other side of said enclosure, then to an upper pulley means, then to a lower pulley means then to an upper pulley means, then to a lower pulley means, all of the last four mentioned pulley means also being located on said other side of said enclosure, thence to another lower pulley means back on said one side.

2. The invention of claim 1, wherein is included a second vertically movable shelf mounted in said enclosure and second cable means coupled with said second shelf at at least three spaced apart locations, each of said upper and lower pulley means comprising a multiple sheave pulley, said second cable means being trained over a second sheave of all of said pulley means in the same sequence as said first cable means.

3. The invention of claim 2, wherein is included a third vertically movable shelf mounted in said enclosure and third cable means coupled with said third shelf at at least three spaced apart locations, each of said upper and lower pulley means comprising at least a three sheave pulley, said third cable means being trained over the third sheave of all of said pulley means in the same sequence as said first and second cable means.

4. The invention of claim 3, wherein is included spring means coupled with each of said movable shelves for exerting an upward force on said shelves.

5. The invention of claim 3, wherein is included means for holding at least one of said second and third shelves in a raised position.

* * * * *

UNITED STATES PATENT AND TRADEMARK OFFICE

CERTIFICATE OF CORRECTION

PATENT NO. : 4,912,359

DATED : March 27, 1990

INVENTOR(S) : Bradley E. Offutt and Larry W. Nelson

It is certified that error appears in the above-identified patent and that said Letters Patent is hereby corrected as shown below:

Col. 8, line 35, "said cable means trained over one of said upper pulley..."

should read

--said cable means being trained over one of said upper pulley...--

Signed and Sealed this

Third Day of September, 1991

*Attest:*

*Attesting Officer*

HARRY F. MANBECK, JR.

*Commissioner of Patents and Trademarks*